US005339891A

United States Patent [19]

Kidaloski et al.

[11] Patent Number: 5,339,891

[45] Date of Patent: Aug. 23, 1994

[54] MODULAR ARRANGEMENT FOR HEAT EXCHANGER UNITS

[75] Inventors: Raymond G. Kidaloski, Canal Fulton; Roger A. Detzel, Norton; Donald E. Byan, Mogadore, all of Ohio

[73] Assignee: The Babcock & Wilcox Company, New Orleans, La.

[21] Appl. No.: 92,156

[22] Filed: Jul. 15, 1993

[51] Int. Cl.[5] ..... F22B 37/24

[52] U.S. Cl. ..... 165/67; 165/81; 122/494; 122/510

[58] Field of Search ..... 165/67, 68, 81; 122/494, 510

[56] References Cited

U.S. PATENT DOCUMENTS

| | | | |
|---|---|---|---|
| 1,830,185 | 11/1931 | Bancel | 165/68 |
| 2,654,352 | 10/1953 | Schoenfeld | 122/494 |
| 3,479,994 | 11/1969 | Kreider et al. | 122/494 |
| 3,608,525 | 9/1971 | Sharan | 122/6 A |
| 4,427,058 | 1/1984 | Bell, Sr. et al. | 165/160 |

FOREIGN PATENT DOCUMENTS

| | | | |
|---|---|---|---|
| 724442 | 12/1965 | Canada | 122/510 |

*Primary Examiner*—Allen J. Flanigan
*Attorney, Agent, or Firm*—Robert J. Edwards; Eric Marich

[57] ABSTRACT

A modular arrangement for containing a heat exchanger module comprises a base frame and four vertical truss members slidably mounted to the base frame at one end of the members. Each vertical truss member is positioned a distance apart from another vertical truss member across the base frame to define a front, a back, and two sides. The heat exchanger unit is contained within the base frame and the vertical truss members. Intermediate tie steel is supported by the four vertical truss members. At least two different levels, each level having a junction fixed to each vertical truss member, are provided. A horizontal side truss member is rotatably attached to the junctions of adjacent vertical truss members and a diagonal truss member extends between and is removably attached to the junctions between adjacent levels. The base frame, the intermediate tie steel, the vertical truss members, and the heat exchanger unit contained therein define a module for transportation and assembly.

14 Claims, 10 Drawing Sheets

10
8
13
55
26
15
40
12
20
30
29

MODULAR ARRANGEMENT FOR HEAT EXCHANGER UNITS

FIELD AND BACKGROUND OF THE INVENTION

The present invention relates in general to heat exchangers and in particular to a new and useful modular arrangement for the shipment and assembly of heat exchanger units.

In recent years, Heat Recovery Steam Generators (HRSG's) have usually consisted of a vertically oriented heat exchanger comprising spirally-finned tubes located inside an externally supported box type structure. High temperature turbine exhaust gas passes through the box and over the tubes in order to recover the heat from the gas.

For economic reasons, it has been common practice to incorporate a modular type design which utilizes a shop fabricated and shop assembled heating surface arrangement. Larger HRSG's are generally two or more modules wide.

Known modular arrangements typically comprise a finned tube heating surface that is bundled complete with top and bottom headers. For ease of handling, these modular shop assembled packages are assembled with an integral shipping truss assembly built of commercially available structural steel shapes.

The finned tube heating surface is shipped in a horizontal position and rotated at the erection site to a vertical orientation. When in its final position, support for the heating surface is normally provided by base frame steel which comprises a part of the shipping truss assembly.

The known box type structure designs comprise internally insulated and lined casing panels which incorporate a cold casing design. These panels can be either a part of the shipping module or they can be installed after the HRSG pressure part modules have been placed in their final position. Column steel attached to these panels provides the overall strength and stability for the total HRSG structure by providing side to side as well as fore and aft restraint against potential loadings which could occur as a result of wind and seismic conditions.

After the modules are rotated into a vertical position and set side by side, the temporary shipping frames between the modules are removed and the pressure parts are left free-standing. Where the shipping steel has been removed, spaces or gas lanes are formed between adjacent modules and between the sidewall casing and the pressure parts. In order to maintain the boiler operating efficiency, it is necessary to block these lanes in order to force the gas through the spirally finned tubes of the heat exchanger by using plates which function as gas barriers.

Support attachments for these gas barriers on most known designs are limited to welds between the finned surface of the heat exchanger and the barrier plates. In addition, intermediate horizontal tie steel, which is used to restrain and support the module load during shipment and to prevent buckling and excessive vibrations during boiler operation, is often directly attached to the spirally finned surface by attachment welds.

However, a major problem exists in that by supporting loads through weld attachments made to the finned surface of the heat exchanger, there is not a high degree of reliability. Because the fins are typically thin (0.06 inches), it is difficult to obtain an effective strength weld attachment. Because the spirally finned tubes are either water or steam cooled, they expand thermally at a different rate than the barrier plates or tie steel which are exposed to the hot turbine exhaust gas. Thus, the rigid welded connections between the pressure parts and the tie or barrier steel are found to result in reduced flexibility at the weld attachment to the fin. This reduced flexibility has often led to attachment failure.

SUMMARY OF THE INVENTION

The present invention is a modular arrangement for containing a heat exchanger unit therein comprising a base frame and four vertical truss members slidably mounted to the base frame at one end of the members. Each vertical truss member is positioned a distance apart from the other vertical truss members across the base frame to define a front, a back and two sides. The heat exchanger unit is contained within the base frame and the vertical truss members.

The arrangement also comprises at least two different levels, each level having a junction fixed to a vertical truss member. A horizontal side truss member is rotatably attached to the junctions of adjacent vertical truss members.

A diagonal truss member is removably attached to the junctions between adjacent levels such that the diagonal truss member diagonally extends from the junction of the one level to the junction of an adjacent level. The vertical, horizontal, and diagonal truss members define a vertical truss. The base frame, the truss members and the heat exchanger unit defines a module.

The present invention allows for two or more modules to be positioned adjacent to each other for being contained within a structure comprising two vertical side trusses positioned a distance apart from each other to define a front, a back, and two sides. The modules are mounted within the casing frame by aligning the vertical side trusses of the module with the casing frame structural members.

The present invention also comprises a plurality of casing panels positioned adjacent each other wherein a joint is formed between adjacent casing panels. The casing panels are a part of the casing support structure and insulate the modules contained therein.

The present invention includes a joint formed between adjacent casing panels and a flexible flange on the casing of each panel at the joint for accommodating expansion and contraction of the casing panels of the casing frame.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

The present invention provides for a novel modular design for heat recovery steam generators in which the module structure is used for packaging, handling, shipping, lifting, and erection and the module support structure remains as an internal, permanent part of the total boiler structure. The present invention ensures that only a small number of temporary steel members must be removed. During boiler operation, the internal structure according to the present invention is used to perform various support and restraint functions.

Figure 1:
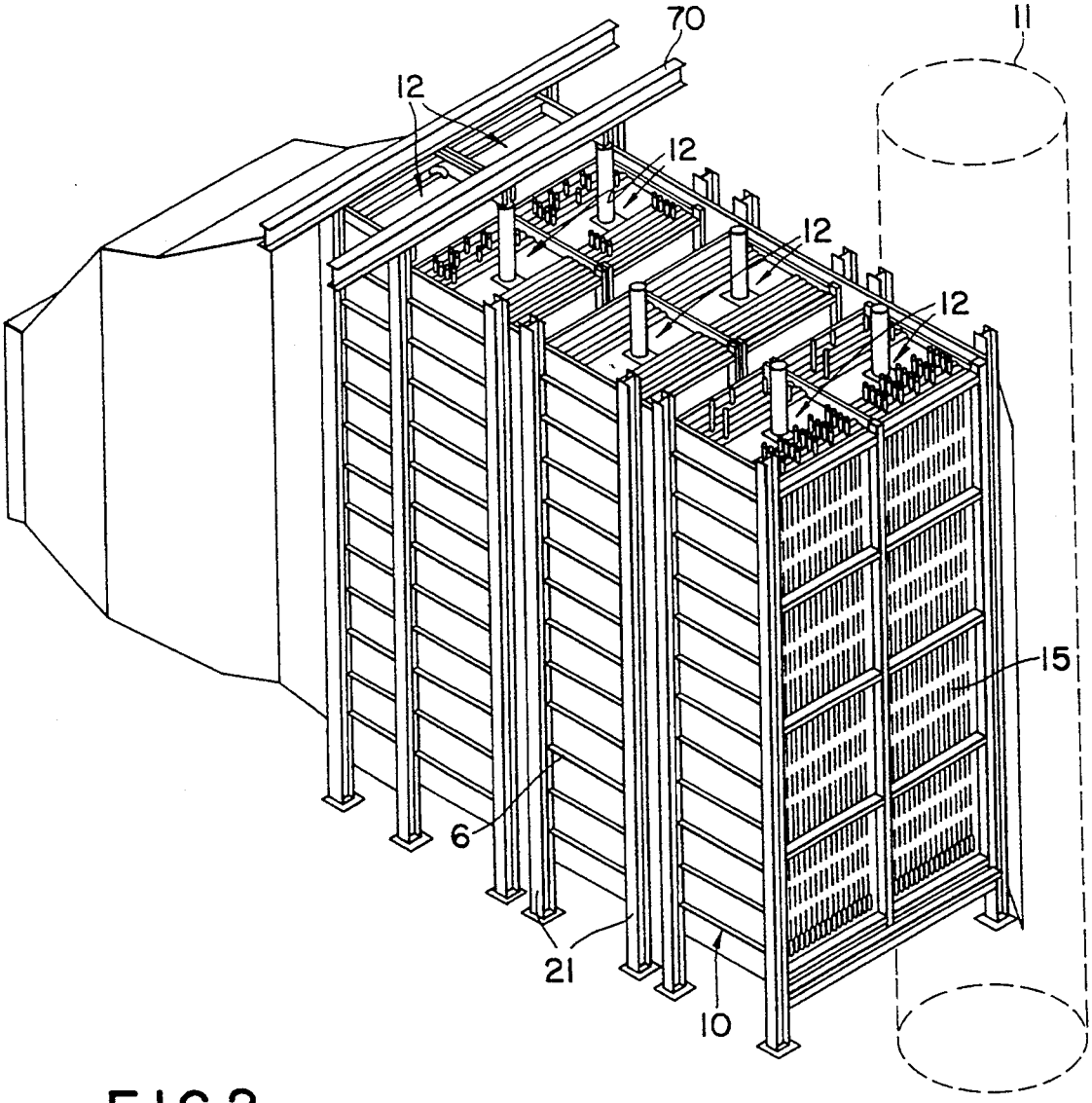
FIG. 1 is a perspective view of a heat exchanger module arrangement.

As illustrated in FIG. 1, the present invention accommodates heat recovery steam generators in modules 12 which are arranged adjacent each other between main column support frame steel 21 which serves as an outer casing for the modules 12. The frame support steel 21 comprises a portion of the casing panel for the modules 12. An outer casing 10 is connected between the frame support steel 21 for providing an insulating casing for the modules 12 of the system. Top steel 70 is connected to the frame support steel 21 for completing the assembly of the top of the system. The top steel 70 is shipped loose and apart from the shipping of the modules 12. A stack 11 is used in conjunction with the modules 12.

Figure 2:
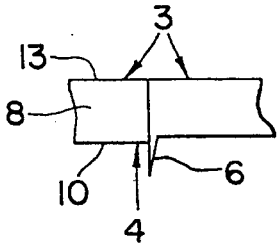
FIG. 2 is a view in section of adjacent casing panels.

As shown in FIG. 2, the present invention provides for the outer casing 10 comprising a plurality of casing panels 3 having an insulation liner 13 which is positioned near the modules 12. An insulation layer 8 is provided on the insulation liner 13 and is sandwiched between the insulation liner 13 and the casing layer 10. The panels 3 are positioned adjacent each other between the frame support steel 21 for forming a joint 4 between the adjacent panels 3.

A flexible expansion flange 6 is provided on the outer casing 10 in order to accommodate maximum cold casing temperatures which are approximately 150° F. and allows for flexibility for the modules 12 (FIG. 1) in the direction of gas flow, i.e. the fore and aft direction. The expansion flange 6 minimizes any accumulative expansion in the fore and aft direction. Each module 12 or group of side-by-side modules, as shown in FIG. 1, is therefore allowed to expand independently relative to adjacent module groups in the fore and aft direction. The flexible expansion flange 6 is located in the cold outside casing 10 for providing easy access during erection of the modules 12.

Figure 3:
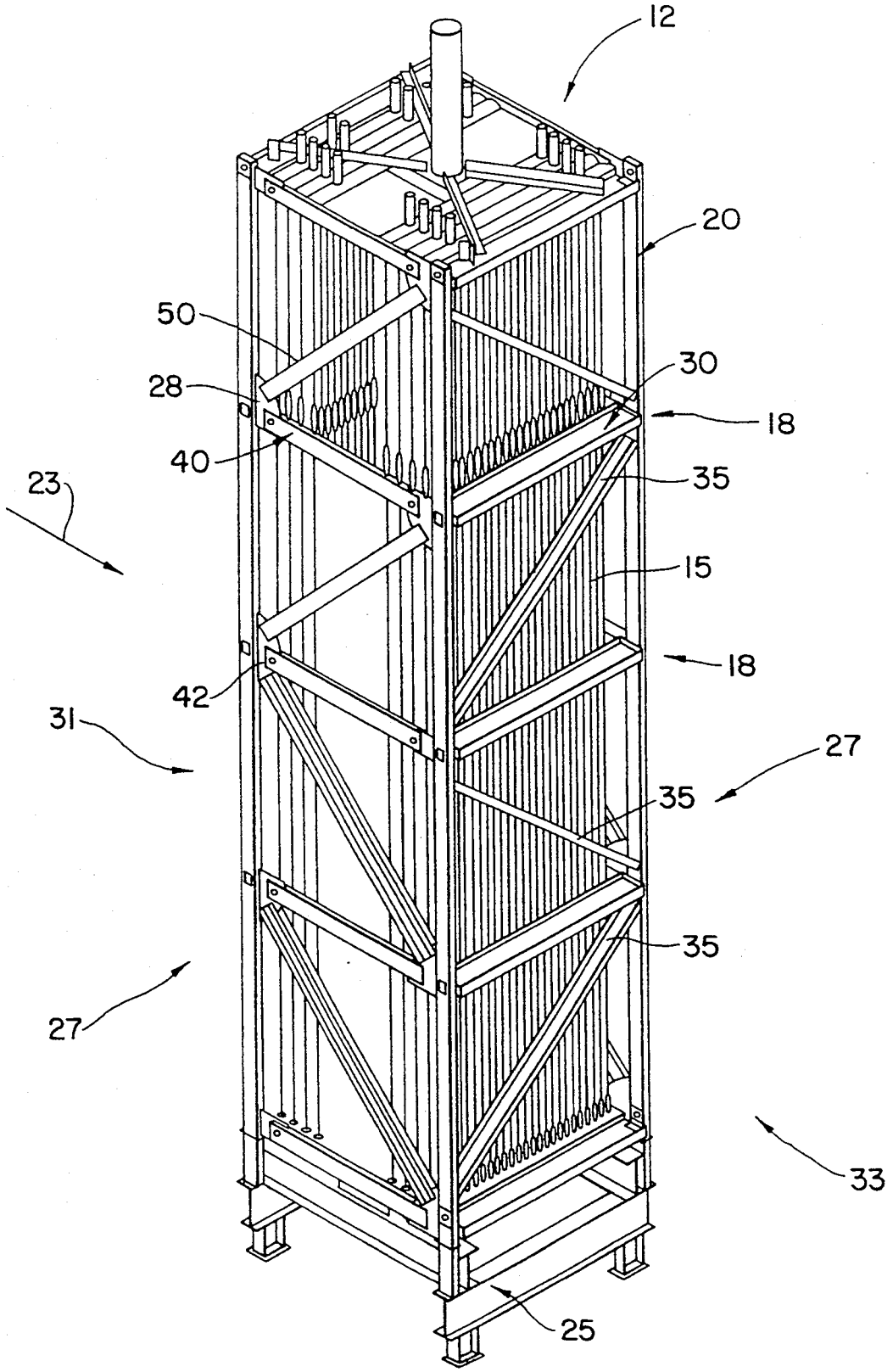
FIG. 3 is a perspective view of a module according to the present invention.

As illustrated in FIG. 3, the present invention provides for a module 12 having vertical members 20 connected at four corners to a module base frame 25 for forming a rectangular or box-type structure. During operation, gas flow through the module 12 is in the direction of arrow 23. A plurality of junctions 28 are positioned along the vertical members 20. The junctions 28 are arranged on opposite sides of the module 12. The junctions 28 are positioned at two opposite sides 27 of the module 12; the front and back of the module 12 being indicated at 31, 33, respectively.

Each module has a plurality of levels 18 which are defined by the junctions 28 along the vertical members 20. A horizontal side truss member 40 is connected between the junctions 28 of adjacent vertical members 20 on opposite sides of the module 12. The horizontal side truss members 40 are secured to the junctions 28 by a junction pin 42. The horizontal side truss members 40 are rotatably attached to the junctions 28 by the junction pin 42 and are permitted to rotate about the junction pin 42.

Figure 4:
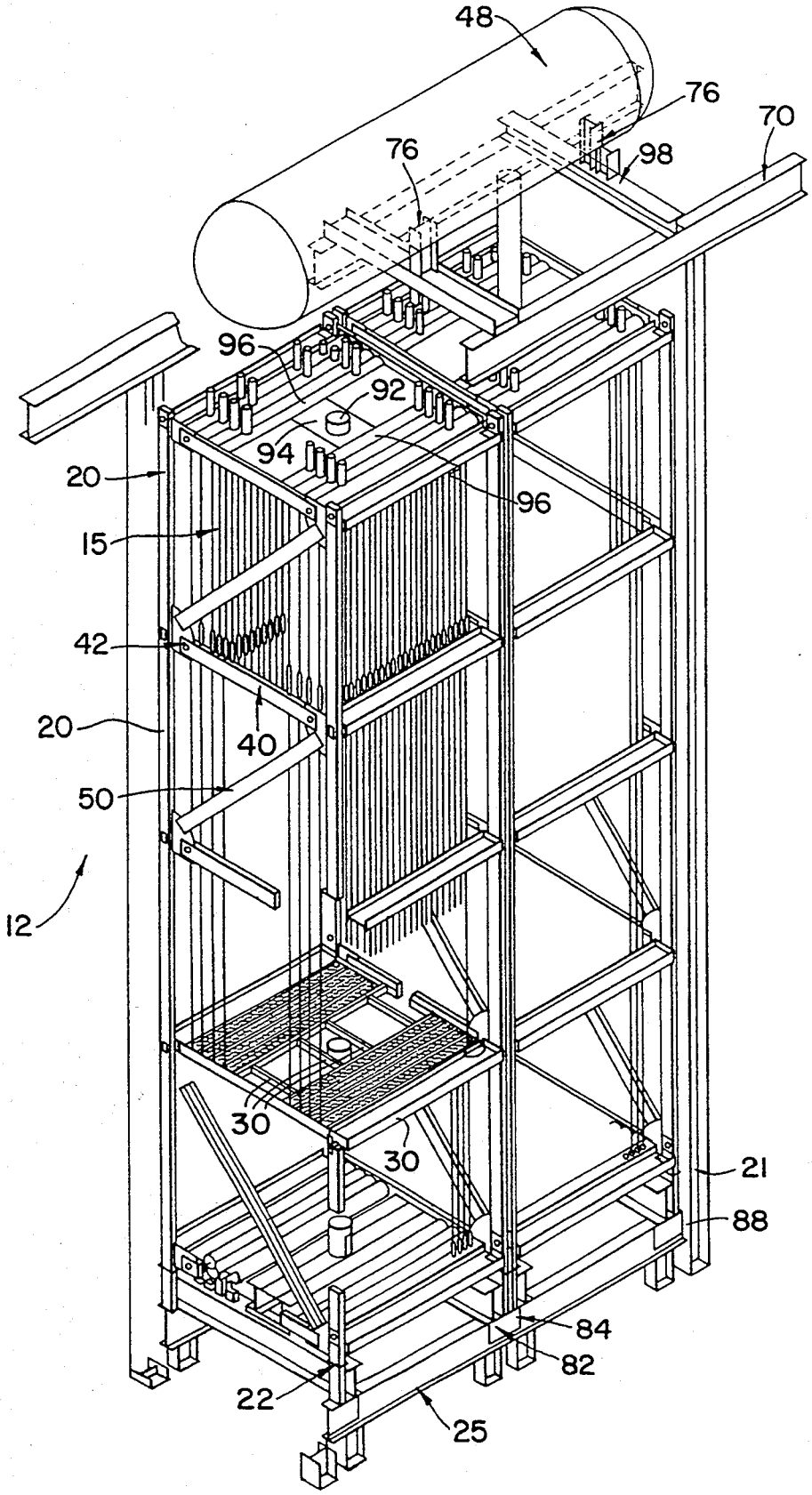
FIG. 4 is a perspective view of a module arrangement according to the present invention.

Temporary diagonal truss members 50 are connected between diagonally positioned junctions 28 at each level 18. The diagonal truss members 50 are removably attached to the junctions 28 for shipping and/or erecting purposes. Referring to FIGS. 3 and 4, by removing the diagonal truss members 50, differential axial thermal growth between the vertical members 20 is permitted by allowing the horizontal side truss members 40 to rotate about the junctions 28. A plurality of heating surfaces 15, such as spirally-finned tubes, are supported by the module base frame 25 and contained within the vertical members 20.

Figure 15:
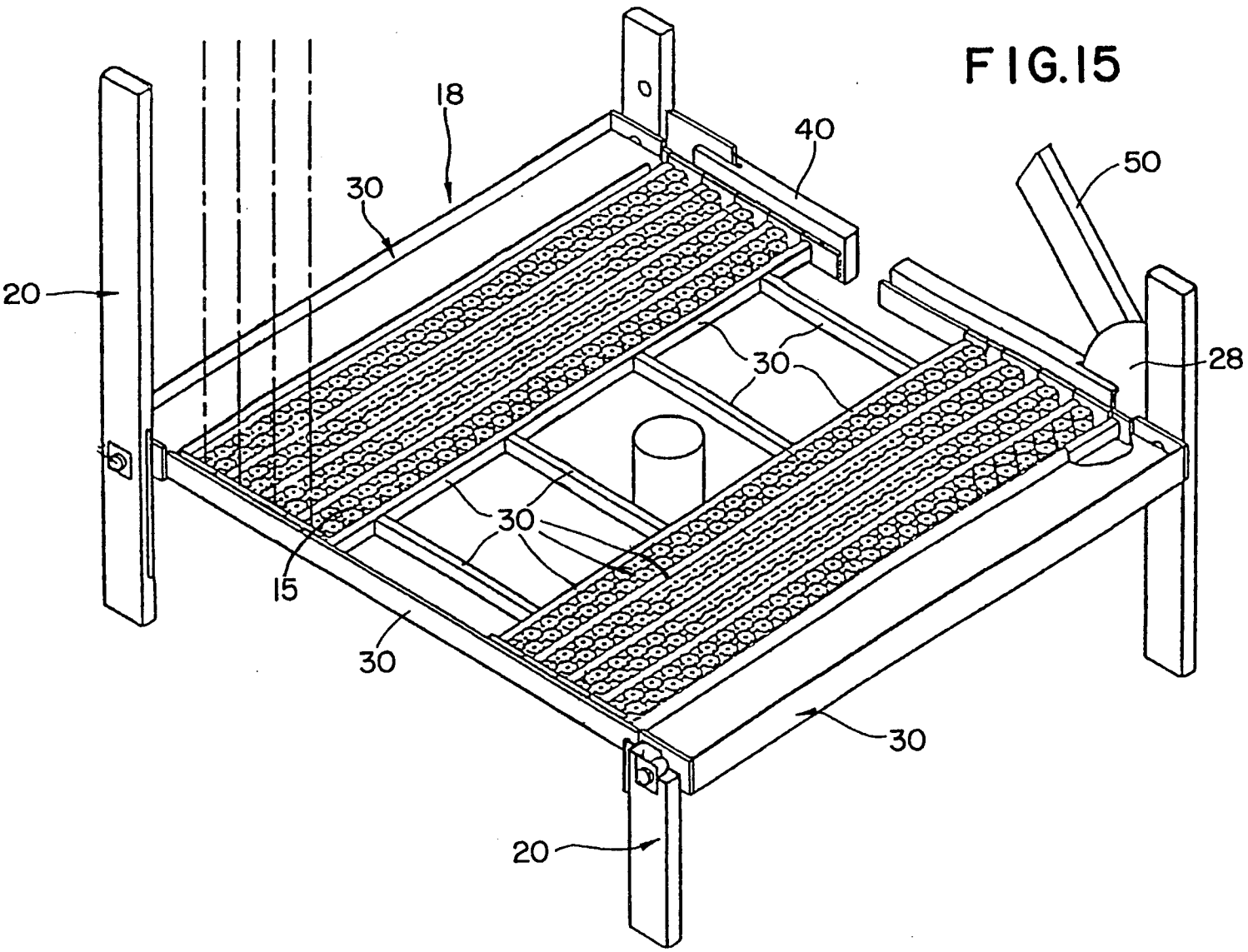
FIG. 15 is a perspective view in section of a level according to the present invention.

The present invention allows for the modules 12 to be shipped separately, set into position and joined together in the field. A bottom pressure casing is part of the module 12 where practical. The side casing 10 (FIG. 1), however, is shipped separately with the column steel 21 attached thereto. As shown in FIG. 15, the vertical members 20 comprise rectangular tubing which remain in place in order to become an integral part of the permanent boiler structure. The present invention provides additional operation stability for the heating surface 15 (FIG. 3) during the boiler operation. As shown in FIGS. 3 and 4, the module 12 has a bottom support frame base frame 25 which is integral and permanent with the module 12.

Figure 7:
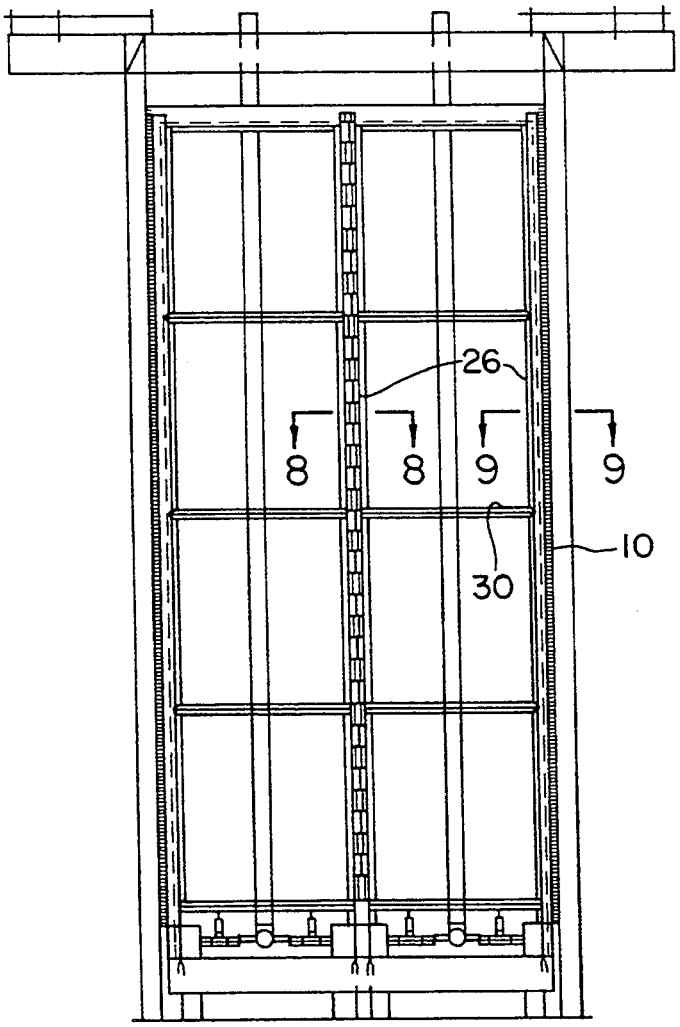
FIG. 7 is a front view of a portion of the present invention.

As shown in FIGS. 4, 7, and 15, the internal structure of the present invention also supports intermediate tie steel 30 and barrier plate steel 26. Permanent diagonal truss members 35 provide stability during operation and transport of the modules 12, the latter of which is typically by rail car. While the intermediate tie steel 30 is provided at each intermediate level between the base frame 25 and the top of the module 12, for shipping purposes the permanent diagonal truss members 35 are only needed on the back side of the module 12. During the erection of the modules 12, any required structure attachments involving the barrier plates 26 (FIG. 7) are made to the internal structure. In known HRSG systems, the barrier plates are connected directly to the heating surface. The present invention differs from known designs in this aspect as will be described later.

FIG. 4 shows two modules 12 adjacent or side-by-side each other. The frame support steel 21 is a permanent external support structure and is attached to the modules 12, at four separate locations to the base frame 25 of the module 12.

Figure 5:
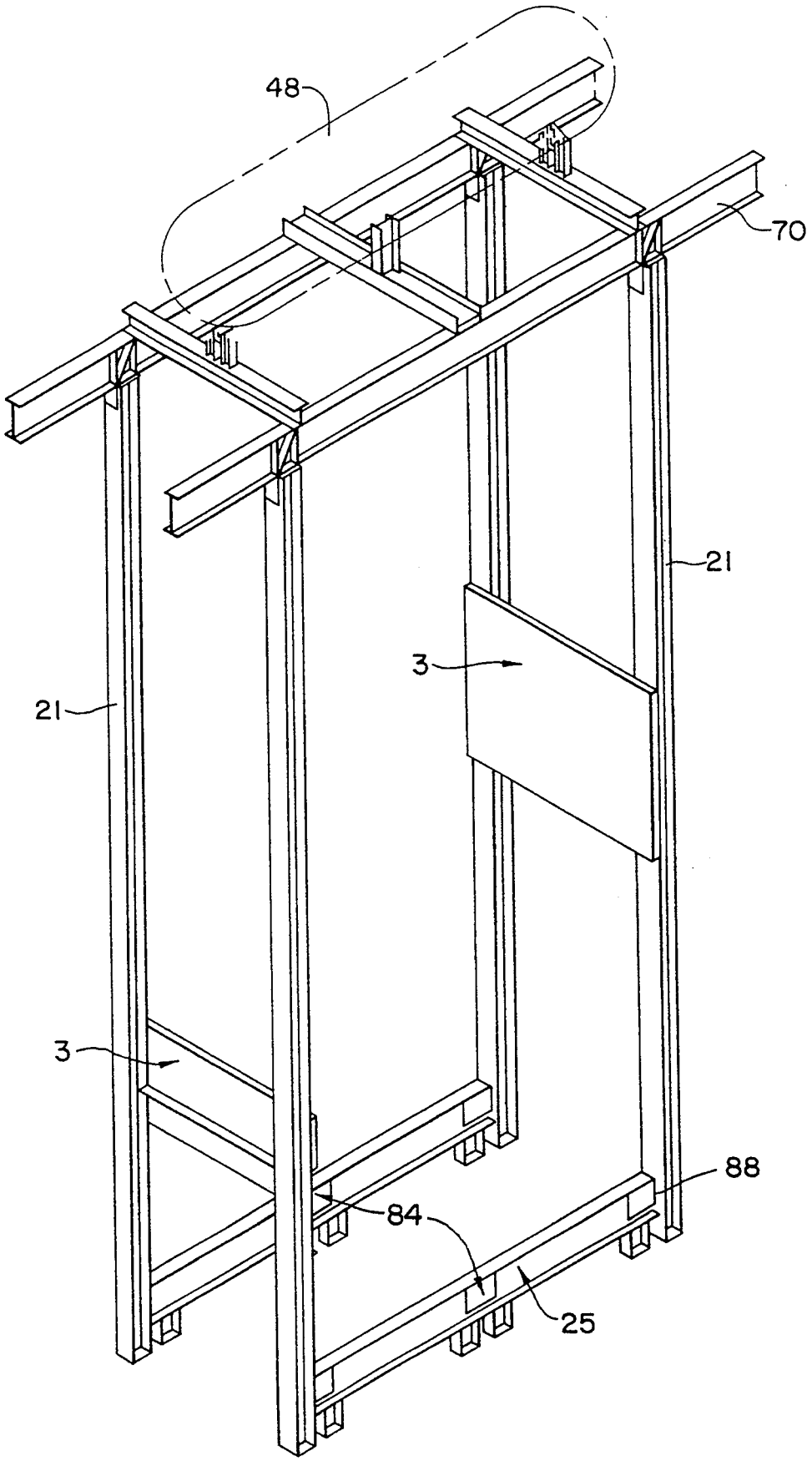
FIG. 5 is a perspective view of an outer support frame according to the present invention.
Figure 14:
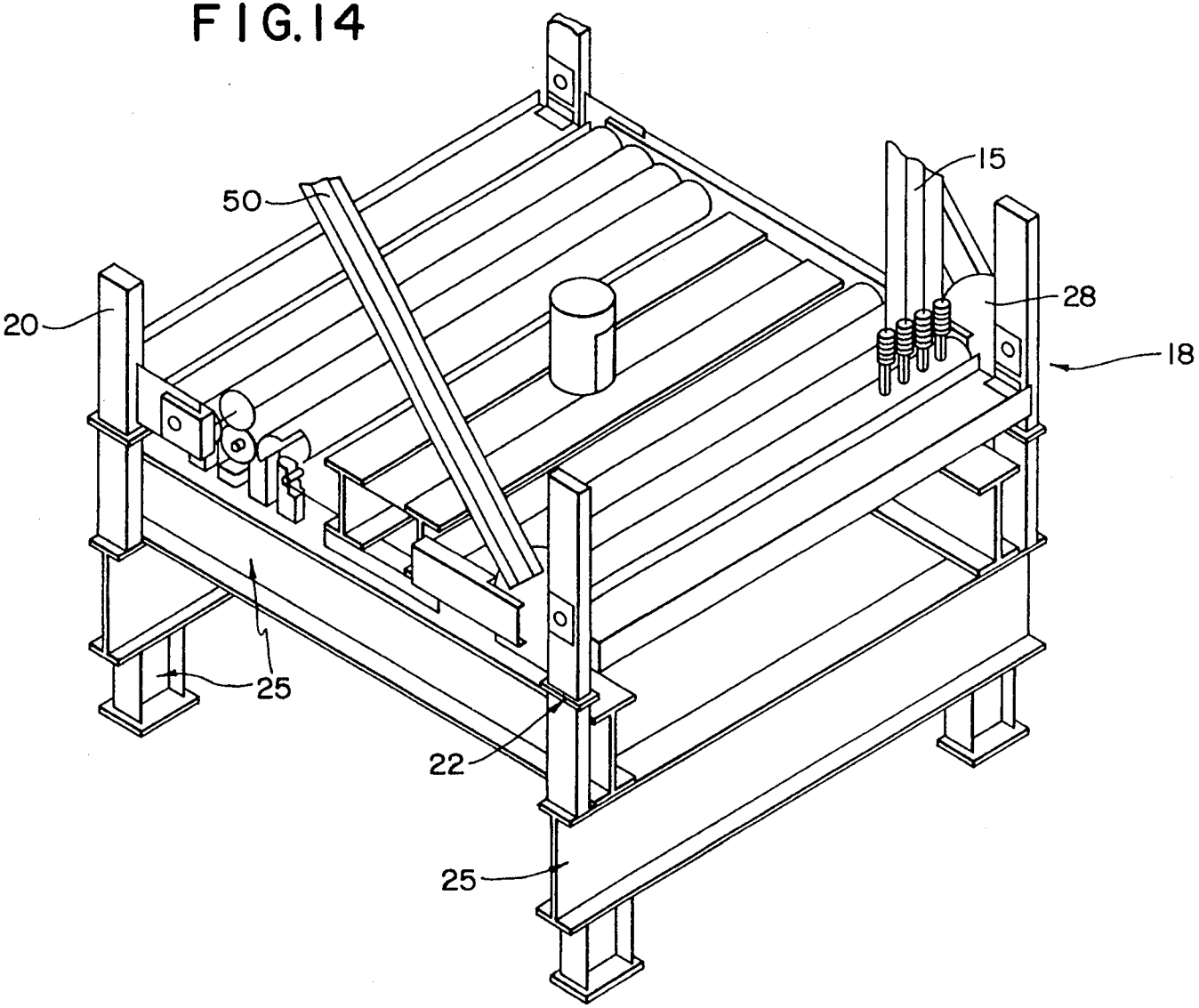
FIG. 14 is a perspective view illustrating a base frame according to the present invention.

Additionally, as illustrated in FIGS. 4 and 14, the vertical members 20 of the module 12 are slidably connected to the base frame 25 at 22, i.e. one end of the vertical members 20. The sliding connection 22 allows the module 12 to grow horizontally due to the thermal differential expansion which occurs between the hot internal structure and the cold base frame frame steel 25. FIG. 4 shows that the side-to-side base frame frame steel 25 is spliced together between the modules 12 at a splice point 82 and is spliced together through the use of splice plate 84. The modules 12 are connected to the column steel 21 at the base frame 25 of the module 12 at connection point 88 in order to form the lower portion of the moment resisting external frame. An illustration of the exterior moment resisting support frame is shown in FIG. 5 with the modules and casing removed for illustration purposes.

Figure 6:
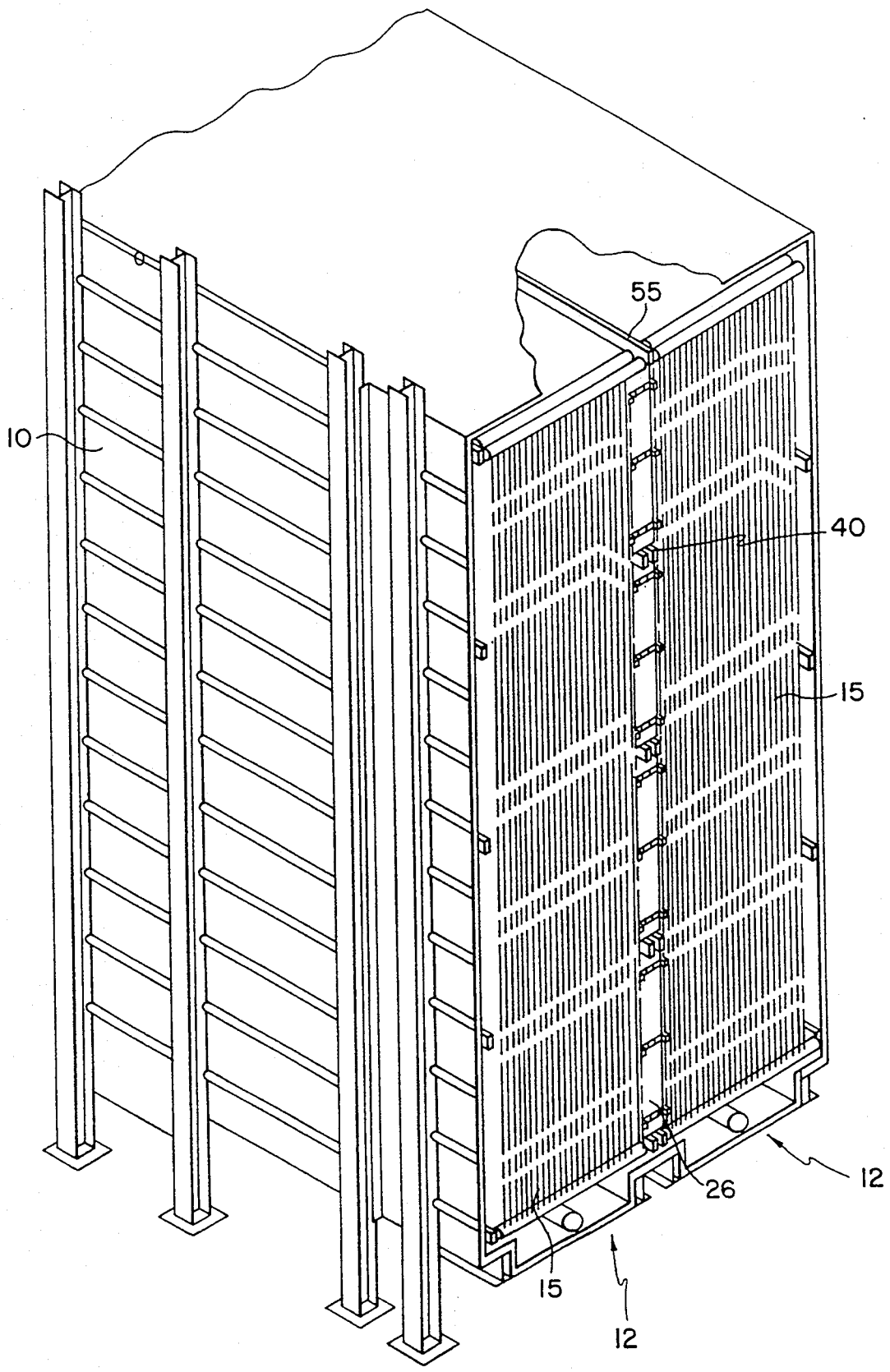
FIG. 6 is a perspective view of a portion of the present invention.

FIG. 4 also illustrates the top of the module 12 connected horizontally via restraints at a downcomer 92, a plurality of top plates 94, headers 96 and external structural support steel 98. Specifically, the headers 96 are secured to the top of the module by the external structural support steel 98. The plates 94 are horizontally secured to the headers 96 and are restrained by the downcomers 92. The downcomers 92 are in turn attached to a drum 48. The drum 48 is free to expand vertically but is connected side-to-side and fore and aft to the external structural support steel 98 at fore and aft tie points 76. By anchoring the individual modules 12 through the drum restraints to the top steel, as mentioned above, the present invention provides a means for accommodating seismic conditions during boiler operation. FIG. 6 shows that when the modules 12 are arranged adjacent each other, a gas lane or gas passage 55 forms between the modules 12. The present invention provides for the use of gas barriers or baffles 26 to block the gas lanes 55 between the modules 12. A plurality of barriers 26, having a short length, are used to block the gas lanes 55 for easier handling purposes.

Figure 8:
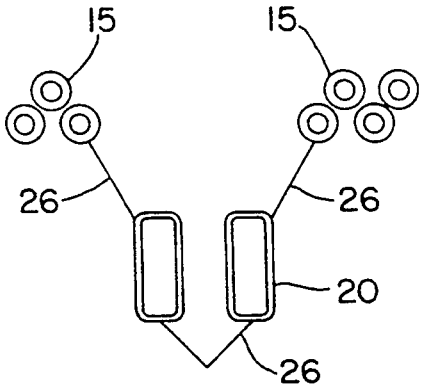
FIG. 8 is a view in horizontal cross-section of a section of FIG. 7.
Figure 9:
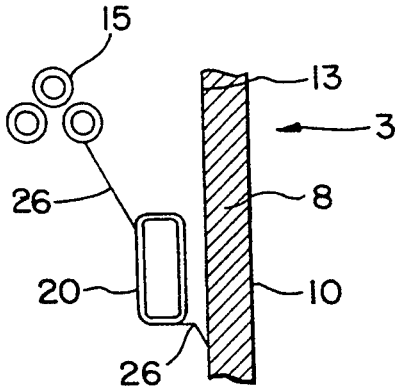
FIG. 9 is a view in horizontal cross-section of a second portion of FIG. 7.
Figures 10, 11, 12, 13:
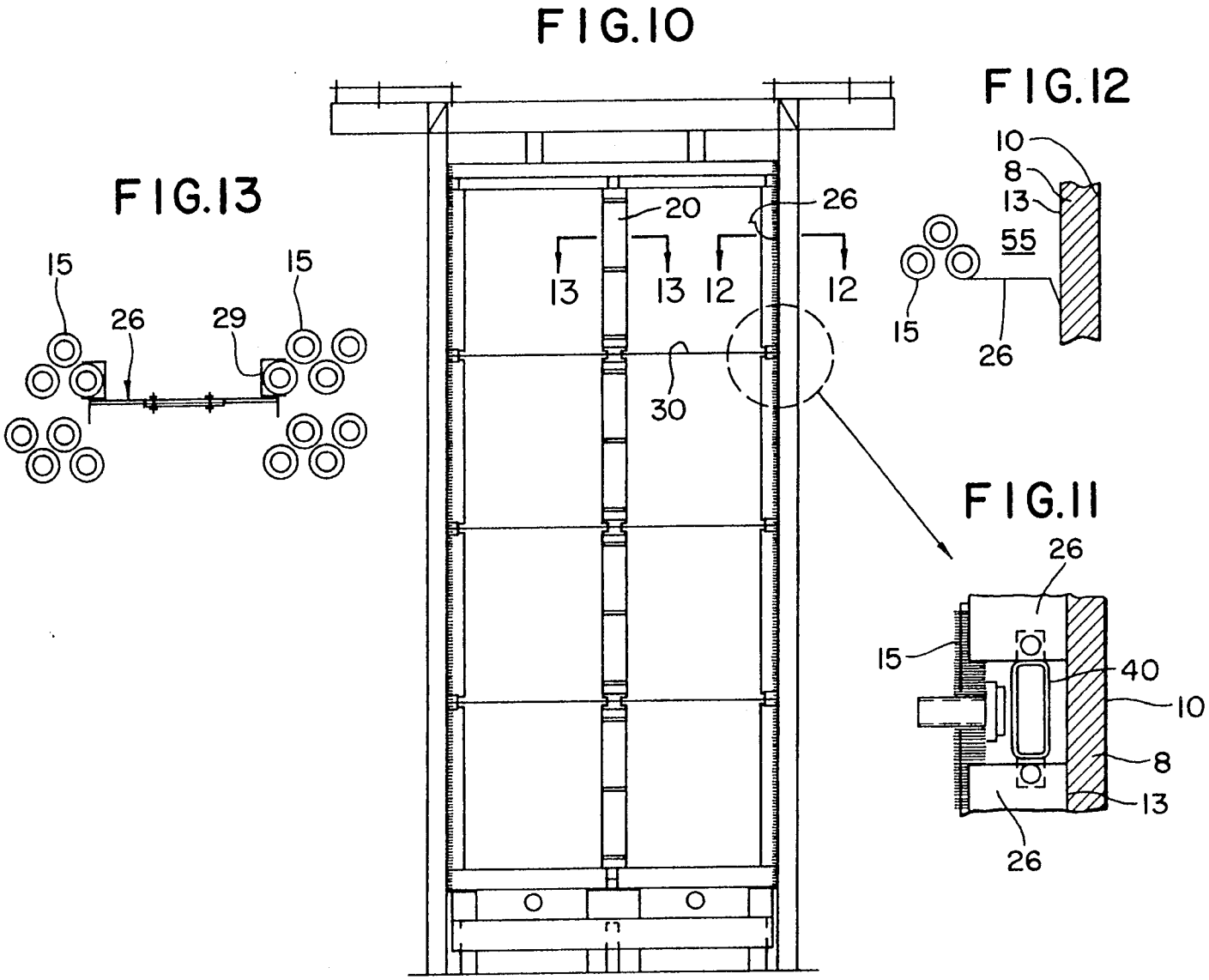
FIG. 10 is a view similar to FIG. 7.
FIG. 11 is an expanded view of a section of FIG. 10.
FIG. 12 is a view in horizontal cross-section of a second section of FIG. 10.
FIG. 13 is a view in horizontal cross-section of a third section of FIG. 10.
Figure 16:
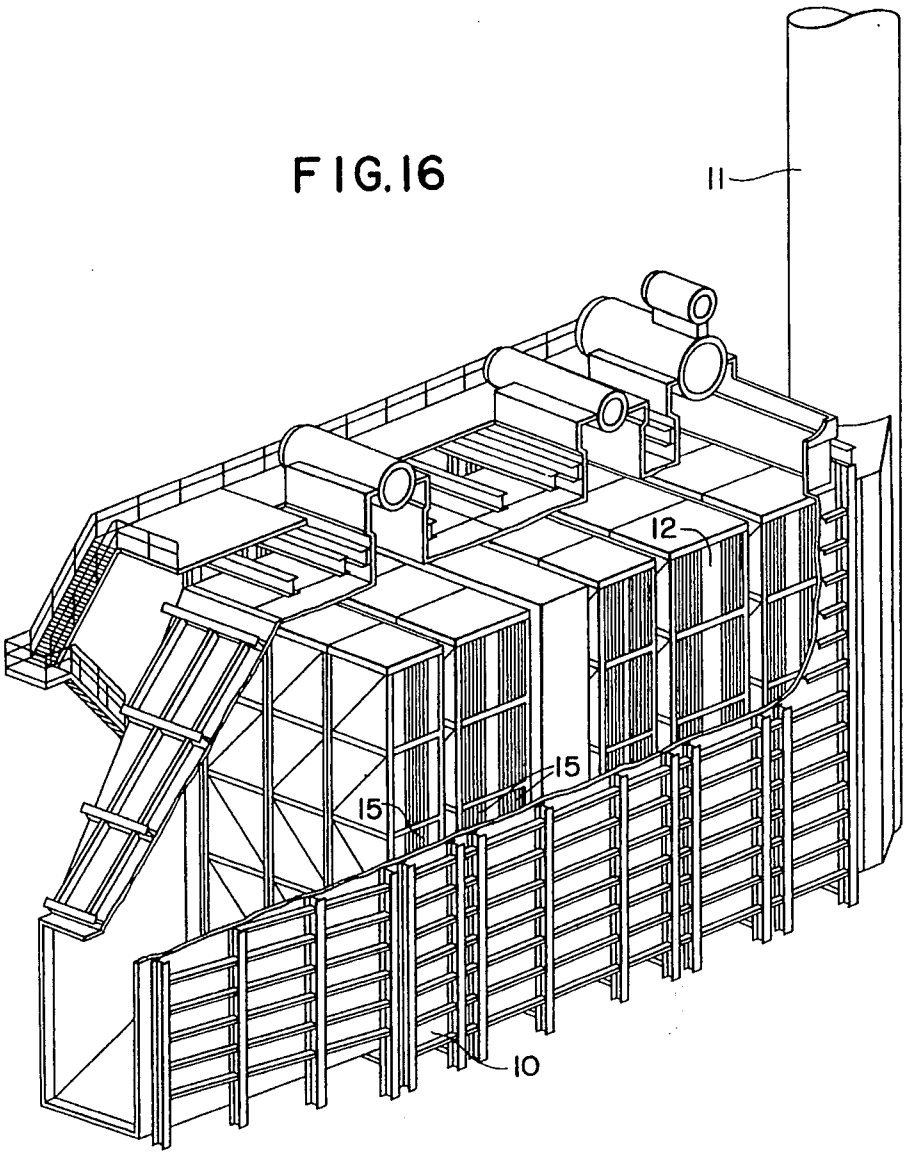
FIG. 16 is a perspective view of a modular arrangement according to the present invention.

As shown in FIGS. 7, 8, 9, 10 and 11, the gas barriers 26 are positioned and supported from the horizontal members 30 of the module support structure. This type of arrangement is more reliable in that the members 30 of the internal structure and the barrier plate steel 26 remain at the same temperature. In addition, there are no rigid attachments between the finned tube surface 15 (FIGS. 1, 6 and 16) and the casing liner 13 (FIGS. 9, 11 and 12). The bend at plate 26, as shown in FIG. 9, at the casing liner 13, results in a tight fit while enabling accommodations of vertical differential expansion between the support member 30 and the liner plate 13. FIG. 8 shows that a center barrier plate 26, is bent at an angle, in order to accommodate any side-to-side expansion between the frames 30.

FIG. 13 shows a barrier plate 26 having ends which are U-shaped brackets 29 which grasp the finned tubes 15 at several locations. The brackets 29 of the barrier 26 allow for the accommodation of differential pressure loading across the barrier plate 26 between modules during operation of the unit. Because the U-shaped brackets 29 grasp the finned tubes 15 and are not welded to the tubes 15, differential growth between the pressure parts 15 and the barrier plate steel 26 is permitted.

The present invention allows for the use of rectangular structural members which results in an efficiently designed shipping truss assembly. Thus, a maximum amount of shippable pressure parts can be obtained by minimizing the size, width, and weight of the shipping trusses.

The present invention provides for a positive means of supporting weight and accommodating loads acting on the intermediate ties 30 and the gas barrier plates 26 during operating conditions. The internal support structure, which remains permanently in place during boiler operation, provides for differential thermal growth between the cold base frame steel 25 and the hot module support structure members.

The internal support structure of the present invention provides an additional means for transferral of seismic loading to the top and bottom of the pressure part module. The present invention also provides internal support structure horizontal member ends which are pinned to accommodate the effects of vertical differential thermal growth between the front and rear vertical support members during operating conditions.

There is no requirement for field welding between the finned tubes 15 and the gas baffle plates 26 according to the present invention. Because the barrier plates 26 are not welded to the fined tubes 15, vertical differential thermal growth between the pressure parts and the barrier plates is not restricted. Additionally, in order to better accommodate seismic loadings, the tops of the internal support structures are anchored horizontally to top steel via drum restraints.

While specific embodiments of the invention have been shown and described in detail to illustrate the application of the principles of the invention, it is understood that the invention may be embodied otherwise without departing from such principles.

What is claimed is:

1. A modular arrangement for containing a heat exchanger unit therein, the arrangement comprising:

a base frame;

four vertical truss members slidably mounted to the base frame at one end of the members, each vertical truss member positioned a distance apart from another vertical truss member across the base frame to define a front, a back, and two sides, the heat exchanger unit contained within the base frame and the vertical truss members;

at least one level of intermediate tie steel supported by the four vertical truss members;

at least two different levels, each level having a junction fixed to each vertical truss member, and a horizontal side truss member rotatably attached to the junctions of adjacent vertical truss members; and a diagonal truss member extending between and removably attached to the junctions between adjacent levels, the base frame, the intermediate tie steel, the vertical truss members, and the heat exchanger unit defining a module.

2. The assembly according to claim 1, wherein the horizontal side truss members are rotatably attached to the vertical members by securing means.

3. The assembly according to claim 2, wherein the securing means comprises a pin.

4. The arrangement according to claim 1, including two vertical side trusses spaced apart from each other to define a front, a back and two sides, and a casing frame, the module mounted within the casing frame by aligning the vertical side trusses of the module with the casing frame structural members.

5. The arrangement according to claim 4, including two modules mounted adjacent each other within the casing frame such that the side members of the modules are aligned with the frame sides of the casing frame, the two modules defining a gas lane between the two modules.

6. The arrangement according to claim 5, including a plurality of casing panels mounted to the frame sides of the casing frame.

7. The arrangement according to claim 6, including at least one gas barrier connected ,to the heat exchanger units of adjacent modules at adjacent side truss members for blocking the gas lane.

8. The arrangement according to claim 6, wherein each casing panel comprises a casing, an insulation layer on the casing and a liner on the insulation layer.

9. The arrangement according to claim 8, wherein each casing panel is positioned adjacent another casing panel.

10. The arrangement according to claim 9, including a joint between adjacent casing panels.

11. The arrangement according to claim 10, including a flexible flange on the casing of each panel at the joint.

12. The arrangement according to claim 5, including a drum located at a top of the module and restrained laterally by top steel.

13. The arrangement according to claim 12, including a top plate mounted to the top of the module and restrained laterally by the drum and the top steel.

14. The arrangement of claim 1, including permanent diagonal truss members provided on the back of the module for stability during transportation and operation of the module.

* * * * *

UNITED STATES PATENT AND TRADEMARK OFFICE

CERTIFICATE OF CORRECTION

PATENT NO. : 5,339,891

DATED : August 23, 1994

INVENTOR(S) : Kidaloski, et al.

It is certified that error appears in the above-identified patent and that said Letters Patent is hereby corrected as shown below:

cover page, at Item [75], the third inventor's name is --Donald E. Ryan--.

Signed and Sealed this

Twenty-ninth Day of November, 1994

*Attest:*

Bruce Lehman

BRUCE LEHMAN

*Attesting Officer*

*Commissioner of Patents and Trademarks*